US008424988B2

(12) United States Patent
Tomida et al.

(10) Patent No.: US 8,424,988 B2
(45) Date of Patent: Apr. 23, 2013

(54) RECORDING APPARATUS AND RECORDING POSITION ADJUSTMENT METHOD

(75) Inventors: Akihiro Tomida, Kawasaki (JP); Yoshinori Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 210 days.

(21) Appl. No.: 12/794,574

(22) Filed: Jun. 4, 2010

(65) Prior Publication Data

US 2010/0309240 A1 Dec. 9, 2010

(30) Foreign Application Priority Data

Jun. 8, 2009 (JP) ..... 2009-137339

(51) Int. Cl.
*B41J 29/38* (2006.01)

(52) U.S. Cl.
USPC ..... 347/12

(58) Field of Classification Search ..... 347/12, 347/16, 37, 40–42
See application file for complete search history.

(56) References Cited

U.S. PATENT DOCUMENTS

| | | | | |
|---|---|---|---|---|
| 6,092,939 | A | 7/2000 | Nishikori | |
| 7,585,039 | B2 * | 9/2009 | Ochiai et al. | 347/12 |
| 8,210,638 | B2 * | 7/2012 | Wada et al. | 347/19 |
| 2010/0149245 | A1 * | 6/2010 | Yasutani et al. | 347/16 |

FOREIGN PATENT DOCUMENTS

| | | | |
|---|---|---|---|
| CN | 1496853 | A | 5/2004 |
| EP | 869007 | A2 | 7/1998 |
| EP | 995607 | A2 | 4/2000 |
| JP | 10-329381 | A | 12/1998 |
| JP | 2001-162912 | A | 6/2001 |

* cited by examiner

*Primary Examiner* — An Do
(74) *Attorney, Agent, or Firm* — Canon U.S.A., Inc. IP Division

(57) ABSTRACT

An apparatus records a first pattern used for correcting a shift in positions recorded by a plurality of nozzle arrays and a second pattern used for detecting a conveyance error that occurs when the first pattern is recorded, and changes a correction value according to the detected conveyance error.

16 Claims, 13 Drawing Sheets

RECORDING APPARATUS AND RECORDING POSITION ADJUSTMENT METHOD

BACKGROUND OF THE INVENTION

1. Field of the Invention

The present invention relates to a recording apparatus used for recording an image by discharging ink from a recording head, and a recording position adjustment method of the recording apparatus.

2. Description of the Related Art

When printing is performed using an ink jet recording apparatus, in some cases, positions (recording position) of dots recorded by a plurality of nozzle arrays of a recording head may relatively shift due to, for example, manufacturing error of the recording head. Japanese Patent Application Laid-Open No. 10-329381 discusses a recording method for correcting a relative shift in the recording positions of a plurality of nozzle arrays by recording a test pattern on a recording medium.

Regarding a serial type inkjet recording apparatus, a recording medium is conveyed in a direction different from a scanning direction of a recording head when an image is recorded. If a range of the nozzle arrays, which allows recording in a single scanning, is extended in the nozzle array direction, it will help realize high-speed recording. Conventionally, a connected head is used in the ink jet recording apparatus. The connected head includes a plurality of chips including a nozzle array. The chips partially overlap one another in the nozzle array direction (conveying direction).

Regarding the connected head, in some cases, due to an assembly error of a chip to the recording head, a relative shift in the recording positions by the nozzle arrays may occur in the conveying direction. Thus, in order to improve image quality of an image recorded by a recording apparatus including a connected head, the relative shift in the recording positions by a plurality of nozzle arrays in the conveying direction is to be corrected.

In correcting the relative shift in the recording positions by a plurality of nozzle arrays in the conveying direction, a test pattern recorded on a recording medium can be used. By using the test pattern, the shift amount can be detected.

As a recording method of such a test pattern, after recording a plurality of patterns by some of the nozzle arrays on the upstream side of the conveying direction on a recording medium, the recording medium is conveyed to the downstream. Then, recording is performed over the plurality of patterns by some of the nozzle arrays on the downstream side. In this way, the test patterns are completed.

However, according to such a recording method for recording test patterns, conveying the recording medium is to be performed. Thus, the conveyance error that may occur when the recording medium is conveyed affects the recording position of a dot of the test pattern. Thus, the relative shift of the recording position cannot be accurately corrected.

SUMMARY OF THE INVENTION

According to an aspect of the present invention, an apparatus for scanning a first nozzle array and a second nozzle array in a direction different from a predetermined direction includes a controller configured to cause the first and second nozzle arrays to record on a recording medium a first pattern by conveying the recording medium in the predetermined direction, and a second pattern used for detecting a conveyance error of the conveying, an acquisition unit configured to acquire a correction value, which is used for correcting a relative shift of recording positions of the first and second nozzle arrays according to the first pattern, and the conveyance error according to the second pattern, and a change unit configured to change the correction value according to the conveyance error.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

FIGS. 1 to 4 illustrate an example of a basic configuration of an ink jet recording apparatus (also simply referred to as a recording apparatus) to which the present invention can be applied.

Figure 1:
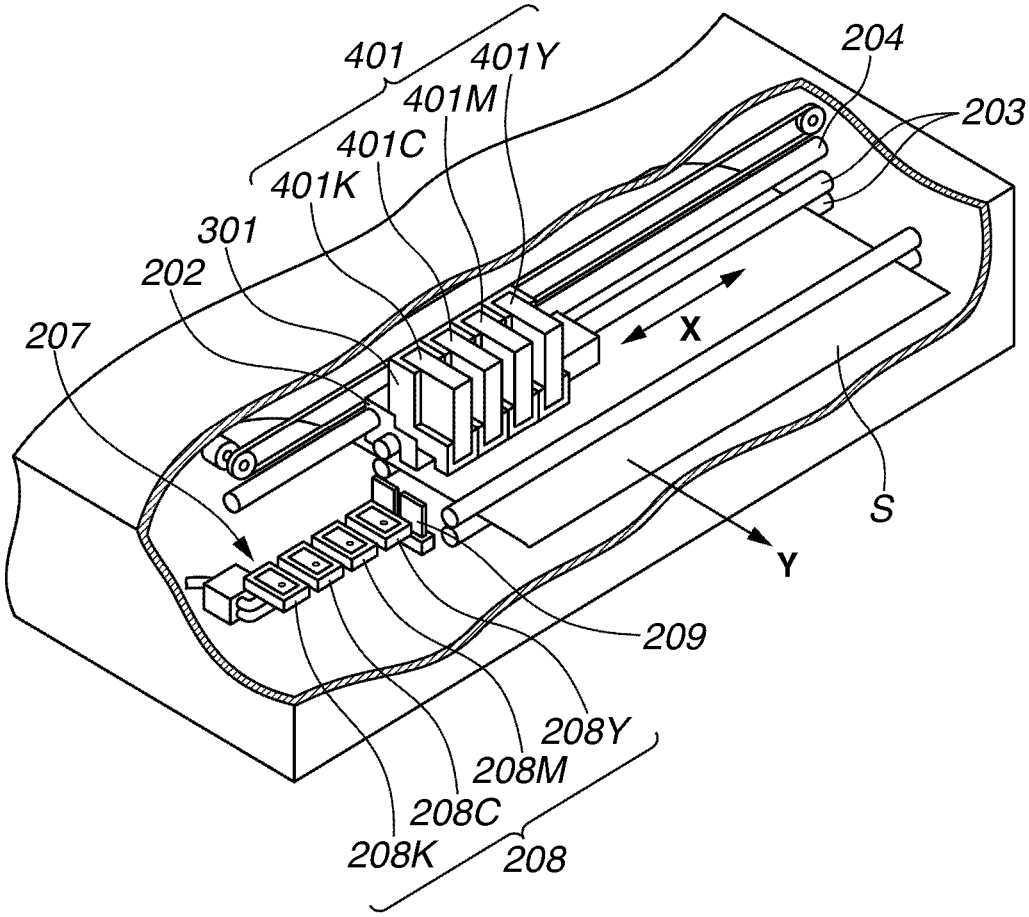
FIG. 1 is a perspective view of a recording apparatus according to a first exemplary embodiment of the present invention.

FIG. 1 is a perspective view that schematically illustrates a main portion of an ink jet recording apparatus according to the present exemplary embodiment.

In FIG. 1, a recording head 301 repeats reciprocating movement in the scanning direction indicated by the arrow X. A recording medium S is, for example, ordinary recording paper, special paper, or an OHP film, and is conveyed in the conveying direction indicated by the arrow Y at a predetermined pitch. The scanning direction is orthogonal to the conveying direction (perpendicular to the conveying direction according to the present exemplary embodiment).

The recording apparatus records an image including characters and symbols by discharging ink droplets on the recording medium S while repeating scanning and conveying operations. The scanning operation is performed to reciprocate the recording head 301 while ink is discharged from a discharge port of the recording head 301 according to data to be recorded. The conveying operation is performed to convey the recording medium S.

The recording head 301 is an ink jet recording unit used for discharging ink using thermal energy. The thermal energy is generated by an electrothermal conversion device included in the recording head 301. Further, the recording head 301 discharges ink from an ink discharge port (nozzle) utilizing change in pressure that occurs according to expansion and contraction of a bubble. The bubble expands or contracts due to film boiling that occurs due to thermal energy. The recording is performed using the discharged ink.

The recording head 301 is detachably mounted on a carriage 202. The carriage 202 is slidably supported by a guide rail 204, and reciprocatingly moved along the guide rail 204 by a driving unit such as a motor (not shown). The recording medium S is conveyed in a conveying direction indicated by the arrow Y by a conveyance roller 203 while a distance between a discharge port face (a face that forms the ink discharge port) of the recording head 301 and the recording medium S is kept constant.

The recording head 301 includes a plurality of nozzle arrays (discharge port arrays) used for discharging ink of different colors. According to the present exemplary embodiment, nozzle arrays, which can discharge black (K), cyan (C), magenta (M), and yellow (Y) ink, are provided. Further, ink cartridges 401 (401K, 401C, 401M, and 401Y), which supply black, cyan, magenta, and yellow ink to the nozzle arrays, are independently and removably mounted on the recording head 301.

A recovery unit 207 is provided to face the surface of the ink discharge port of the recording head 301 when the recording head 301 moves to a non-recording region. The non-recording region is within the range of reciprocation of the recording head 301 and external to a range through which the recording medium S passes.

The recovery unit 207 includes caps 208K, 208C, 208M, and 208Y, which can cap the discharge ports of the recording head 301. The caps 208K, 208C, 208M, and 208Y can cap the discharge ports that discharge black, cyan, magenta, and yellow ink, respectively.

A suction pump (negative pressure generation device) is connected to each of the caps 208K, 208C, 208M, and 208Y. According to a negative pressure generated inside each of the caps 208K, 208C, 208M, and 208Y when the discharge port corresponding to each of the caps is capped, ink can be drawn in and discharged (suction recovery operation) from the discharge port of the recording head 301 to each of the caps 208K, 208C, 208M, and 208Y. According to this suction recovery operation, the ink discharge performance of the recording head 301 can be maintained.

Further, the recovery unit 207 includes a wiper 209. The wiper 209 is, for example, a rubber blade used for wiping the discharge port surface of the recording head 301. Further, the discharge performance of the recording head 301 is also maintained by a discharge of ink from the recording head 301 to the inside of the cap 208. This processing (recovery processing) is also referred to as "preliminary discharge".

Figure 2:
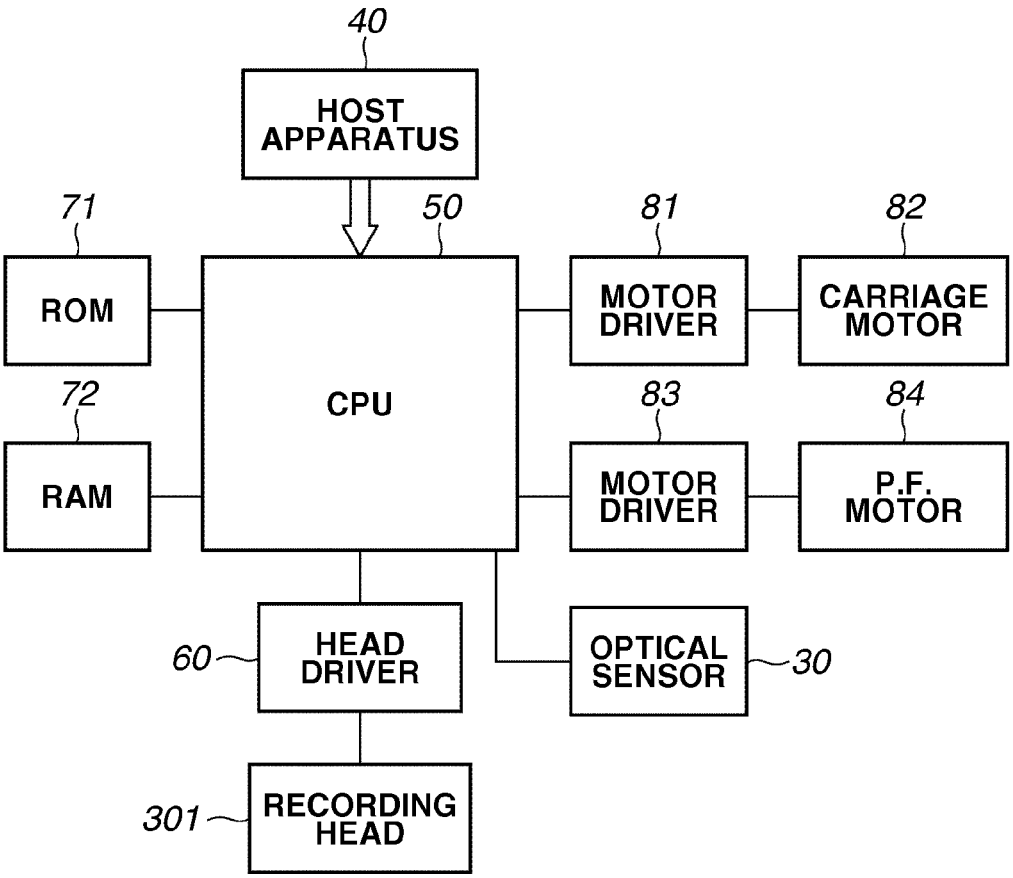
FIG. 2 is a block diagram illustrating a control configuration of the recording apparatus according to the first exemplary embodiment of the present invention.

FIG. 2 is a block diagram illustrating a configuration of a control system of the recording apparatus.

A CPU 50 executes control processing of operations of the recording apparatus including recording position adjustment processing (see FIGS. 9 and 11) and data processing as described below. A ROM 71 stores a program concerning such processing procedures. A RAM 72 is used as a work area when the above-described processing is executed. Additionally, the RAM 72 stores a correction value obtained by the recording position adjustment processing.

The ink is discharged from the recording head 301 according to the CPU 50 supplying drive data (image data) of an electrothermal conversion device in the print head and a drive control signal (heat pulse signal) to a head driver 60. The CPU 50 controls a carriage motor 82 by driving a motor driver 81 so that the carriage 202 moves in the scanning direction. Further, the CPU 50 controls a power function (PF) motor 84 by driving a motor driver 83 so that the recording medium S is conveyed in the conveying direction. An optical sensor 30 is used for reading a reflected light intensity of a test pattern used for the recording position adjustment processing.

A function used for making the recording apparatus execute the recording position adjustment processing can be stored in a host apparatus 40 that supplies image data to the recording apparatus. Further, a correction value used in the recording position adjustment processing can be stored in the host apparatus 40.

Figure 3:
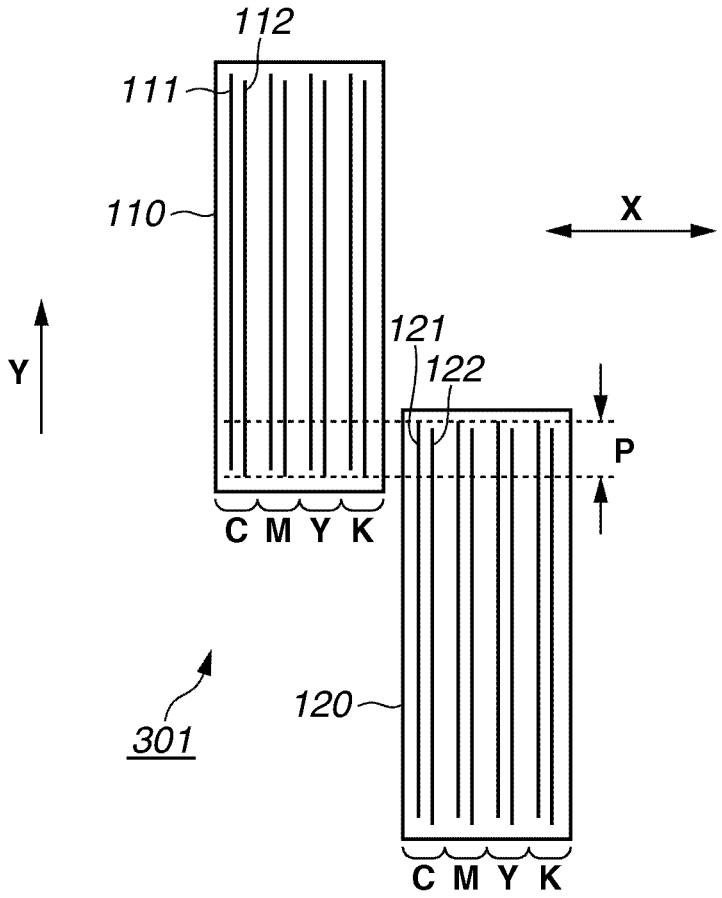
FIG. 3 illustrates a recording head according to the first exemplary embodiment of the present invention.

FIG. 3 illustrates a configuration of a discharge port face of the recording head (connected head) 301 mounted on the carriage 202.

The recording head 301 includes an upstream chip 120, which is mounted on the upstream side with respect to the conveying direction, and a downstream chip 110, which is mounted on the downstream side. Nozzle arrays of black, cyan, magenta, and yellow are provided in each of the chips 110 and 120 along the scanning direction X. Each nozzle array includes a plurality of nozzles for discharging ink arranged in a predetermined direction (conveying direction Y).

According to the present exemplary embodiment illustrated in FIG. 3, two nozzle arrays are provided for each color in the upstream chip 120 and in the downstream chip 110. In FIG. 3, for example, nozzle arrays 121 and 122 for cyan ink are provided in the upstream chip 120. Similarly, nozzle arrays 111 and 112 for cyan ink are provided in the downstream chip 110. Further, the nozzle arrays of the upstream chip 120 and the nozzle arrays of the downstream chip 110 are arranged so that they have an overlapping region P in the conveying direction Y.

According to the present exemplary embodiment, the overlapping region P corresponds to 10 nozzles. Binary record data is distributed between two nozzles in the same position with respect to the conveying direction to perform the recording.

Figure 4:
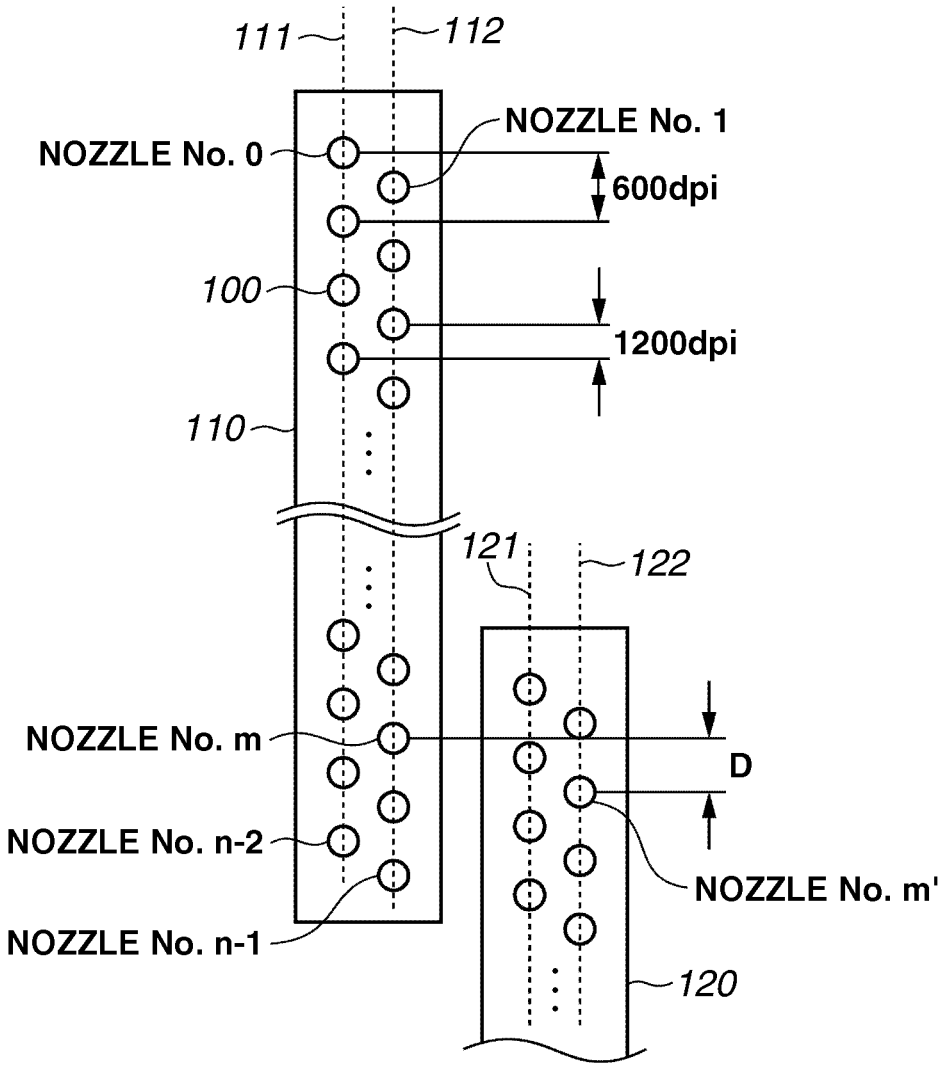
FIG. 4 illustrates a nozzle arrangement of the recording head according to the first exemplary embodiment.

FIG. 4 illustrates a positional relation of the nozzle arrays of the upstream chip 120 and a nozzle 100 in a nozzle array of the downstream chip 110.

FIG. 4 illustrates only four nozzle arrays for cyan ink. Each of the nozzle arrays 111 and 112 of the downstream chip 110 includes a number n/2 of nozzles ("n" is an even number) and the nozzle pitch is 600 dpi. The nozzle arrays 111 and 112 are arranged in such a manner that the difference between each nozzle in the conveying direction Y is 1/1200 inch.

If the nozzle arrays 111 and 112 of the downstream chip 110 are regarded as one nozzle array, the nozzle array will have a number n of nozzles arranged in the conveying direction Y at a nozzle pitch of 1200 dpi. According to the recording position adjustment processing described below, the upstream nozzle arrays 121 and 122 are considered as one nozzle array (a first nozzle array) and the downstream nozzle arrays 111 and 112 are also considered as one nozzle array (a second nozzle array). The shift of the recording positions is corrected according to the recording position adjustment processing.

A nozzle number (No.) 0 is assigned to a furthest downstream nozzle of the nozzle arrays 111 and 112. Then, each nozzle number from "0" to "n−1" is assigned to each nozzle of the nozzle arrays from the downstream side to the upstream side. The nozzle array 111, which is an array of nozzles to which even numbers are assigned, is referred to as an even nozzle array. On the other hand, the nozzle array 112, which is an array of nozzles to which odd numbers are assigned, is referred to as an odd nozzle array. The upstream nozzle arrays 121 and 122 have a similar configuration as the downstream nozzle arrays 111 and 112.

A nozzle No. m of the downstream chip 110 and a nozzle No. m' of the upstream chip 120 are in the overlapping region. If there is no error in the assembling of the chips (i.e., ideal condition), the position of the nozzle No. m and the position of the nozzle No. m' will be the same with respect to the conveying direction Y. According to mask patterns in a complementary relationship, the same record raster data generated from the image data is assigned to these two nozzles.

Thus, if an error occurs with respect to the assembly of the downstream chip 110 and the upstream chip 120, and a shift D concerning the positional relation of the nozzle arrays of the downstream chip 110 and the nozzle arrays of the upstream chip 120 is generated as illustrated in FIG. 4, the impact positions of the dots recorded by each nozzle array are shifted. As a result, the image quality is reduced.

According to the recording position adjustment processing of the present exemplary embodiment, when a test pattern used for detecting a shift of the recording positions in the conveyance direction of the nozzle arrays is recorded incorporating the conveying operation of a predetermined conveyance amount, a test pattern used for detecting an amount of conveyance error that occurred in the conveyance operation is also recorded.

Then, based on the detected amount of the conveyance error, the relative shift amount of the recording position of the nozzle arrays in the conveying direction (or a recording position shift correction value) is changed. In this way, since the influence of the conveyance error at the time the test pattern is recorded can be reduced, accurate correction of the shift in the recording positions of the nozzle arrays in the conveying direction becomes possible.

The recording position adjustment processing according to the present exemplary embodiment will now be described in detail. The recording position adjustment processing according to the present exemplary embodiment is performed in the order of "recording of test pattern", "reading of optical density", and "calculation of correction value". When the actual recording is performed, the recording position is corrected according to the obtained correction value. The test pattern used for detecting the shift in the recording positions of the nozzle arrays in the conveying direction is also referred to as a "recording position correction pattern", and the test pattern used for detecting the amount of conveyance error of the recording medium is referred to as a "conveyance error detection pattern".

Figure 5:
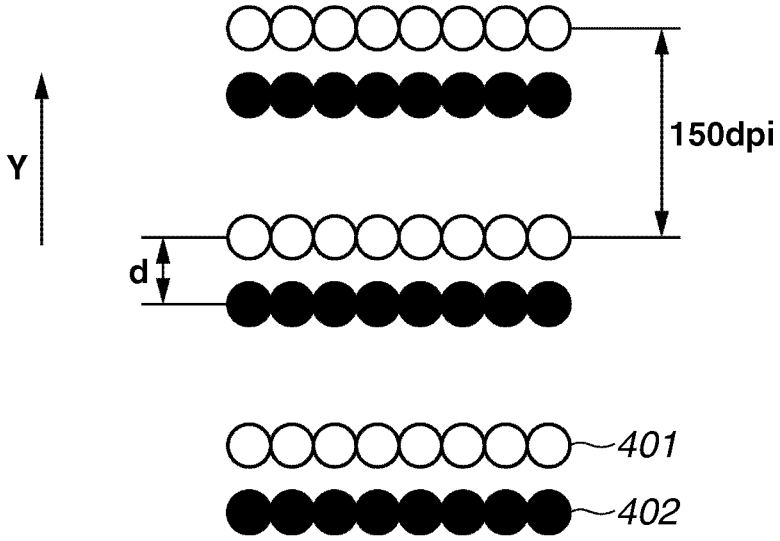
FIG. 5 illustrates a patch according to the first exemplary embodiment.

FIG. 5 illustrates a test pattern (hereinafter also simply referred to as a pattern) according to the present exemplary embodiment.

The test pattern includes a plurality of patches. Each patch is completed by recording a reference pattern and a non-reference pattern with the non-reference pattern being shifted for a predetermined shift amount D in the conveying direction with respect to the reference pattern. FIG. 5 illustrates a reference pattern 401 and a non-reference pattern 402 of one patch. The reference pattern 401 and the non-reference pattern 402 are patterns including a plurality of lines formed by dots arranged in the conveying direction Y at regular intervals of 150 dpi (8 nozzles).

Figure 6:
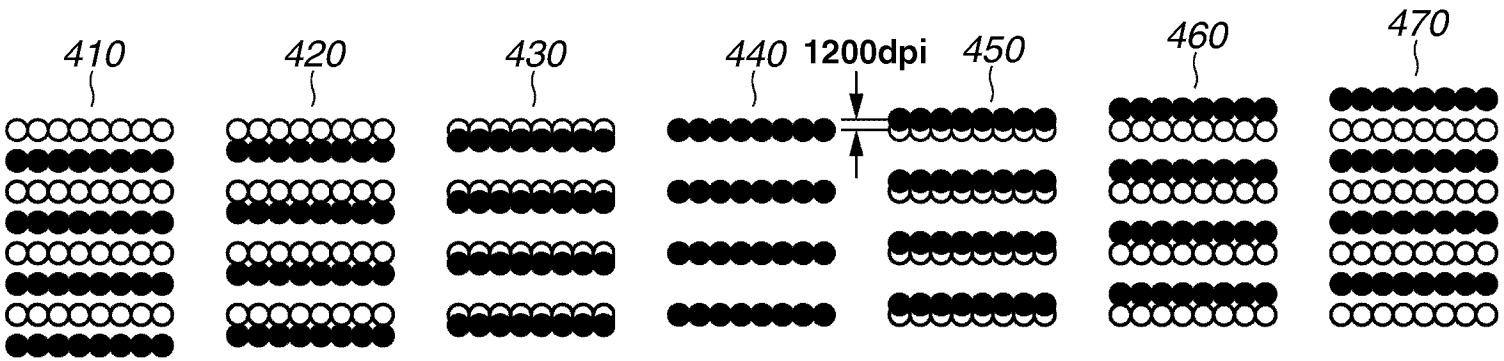
FIG. 6 illustrates a test pattern according to the first exemplary embodiment.

The test pattern will now be described referring to FIG. 6.

The test pattern includes seven patches 410 to 470 having relative positions of the reference pattern 401 and the non-reference pattern 402 different in the conveying direction. The relative position of the non-reference pattern 402 with respect to the reference pattern 401 of the patches 410 to 470 is shifted at a pitch of 1200 dpi.

Such a pattern can be recorded by shifting the nozzles used in recording the non-reference pattern one by one. Further, in an ideal condition, in the patch 440, the recording position of the non-reference pattern coincides with the recording position of the reference pattern. Regarding the recording position correction pattern in the ideal condition, there is no difference in the relative position between the nozzle array of the upstream chip and the nozzle array of the downstream chip.

Further, regarding the conveyance error detection pattern in the ideal condition, deviation of the impact positions of the dots due to the conveyance error of the recording medium does not occur. In this ideal condition, the relative positional difference of the non-reference pattern with respect to the reference pattern is called a "shift amount". According to the present exemplary embodiment, the above-described test pattern is used for the recording position correction pattern as well as for the conveyance error detection pattern.

Figure 7A:
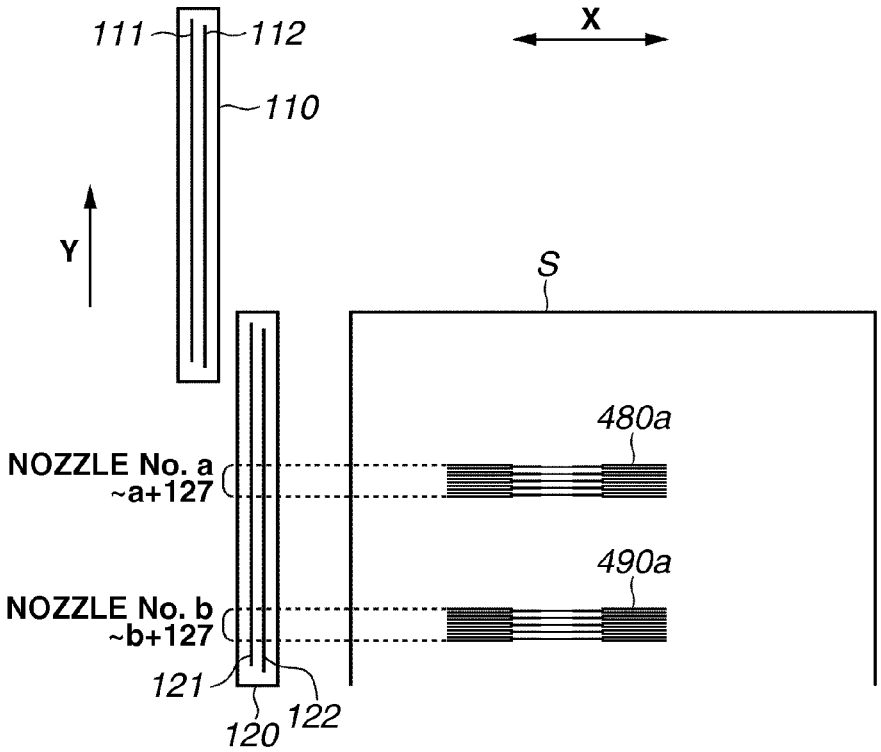
FIGS. 7A to 7C illustrates a recording method of the test pattern according to the first exemplary embodiment.

Next, a method for recording a recording position correction pattern 480 and a conveyance error detection pattern 490 will be described referring to FIGS. 7A to 7C. FIG. 7A illustrates a method for recording a reference pattern 480*a* of the recording position correction pattern 480 as a first reference pattern and a reference pattern 490*a* of the conveyance error detection pattern 490 as a second reference pattern.

First, the recording medium S is conveyed so that the recording medium S is in the recording region of the upstream chip 120. After then, by moving the recording head 301, the reference pattern 480*a* of the recording position correction pattern (seven patches) is recorded using the 128 nozzles starting from nozzle No. "a" of the upstream chip.

When the recording head moves to record the reference pattern 480*a*, the reference pattern 490*a* of the conveyance error detection pattern (seven patches) is also recorded by different nozzles (128 nozzles from nozzle No. "b"). The number of the nozzles used in the recording of the test patterns is set to 128 nozzles since the length corresponding to 128 nozzles is approximately 2.7 mm when the nozzle pitch is 1200 dpi. This patch length is sufficient for the detection of the reflected light intensity by the optical sensor. When the recording of the reference patterns of the recording position correction pattern and the conveyance error detection pattern is completed, the recording medium S is conveyed for a predetermined conveyance amount L.

Figure 7B:
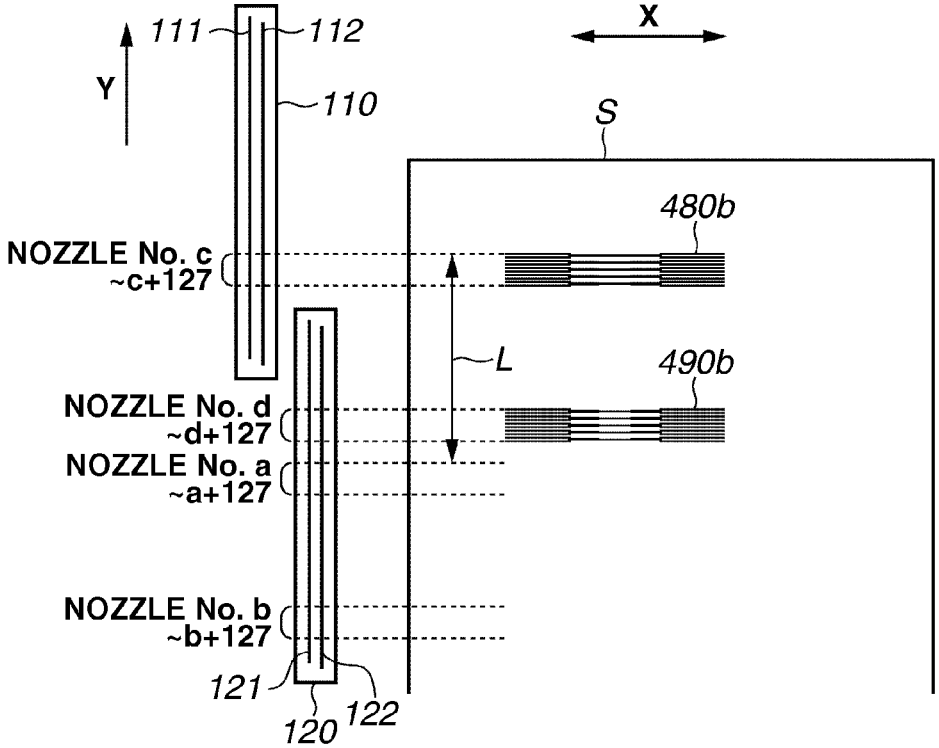

FIG. 7B illustrates a conveyance operation for conveying the recording medium S for the predetermined conveyance amount L. After the conveyance of the recording medium S, a non-reference pattern 480*b* of the recording position correction pattern as the first non-reference pattern is recorded using 128 nozzles starting from a nozzle of nozzle No. c of the downstream chip. Further, a non-reference pattern 490*b* of the conveyance error detection pattern as the second non-reference pattern is recorded using 128 nozzles starting from a nozzle of nozzle No. d of the upstream chip.

Thus, the distance between the 128 nozzles of the upstream chip 120 from the nozzle No. a and the 128 nozzles of the downstream chip 110 from the nozzle No. c corresponds to the predetermined conveyance amount L. Similarly, the distance between the 128 nozzles of the upstream chip 120 from the nozzle No. b and the 128 nozzles of the upstream chip 120 from the nozzle No. d corresponds to the predetermined conveyance amount L.

Figure 7C:
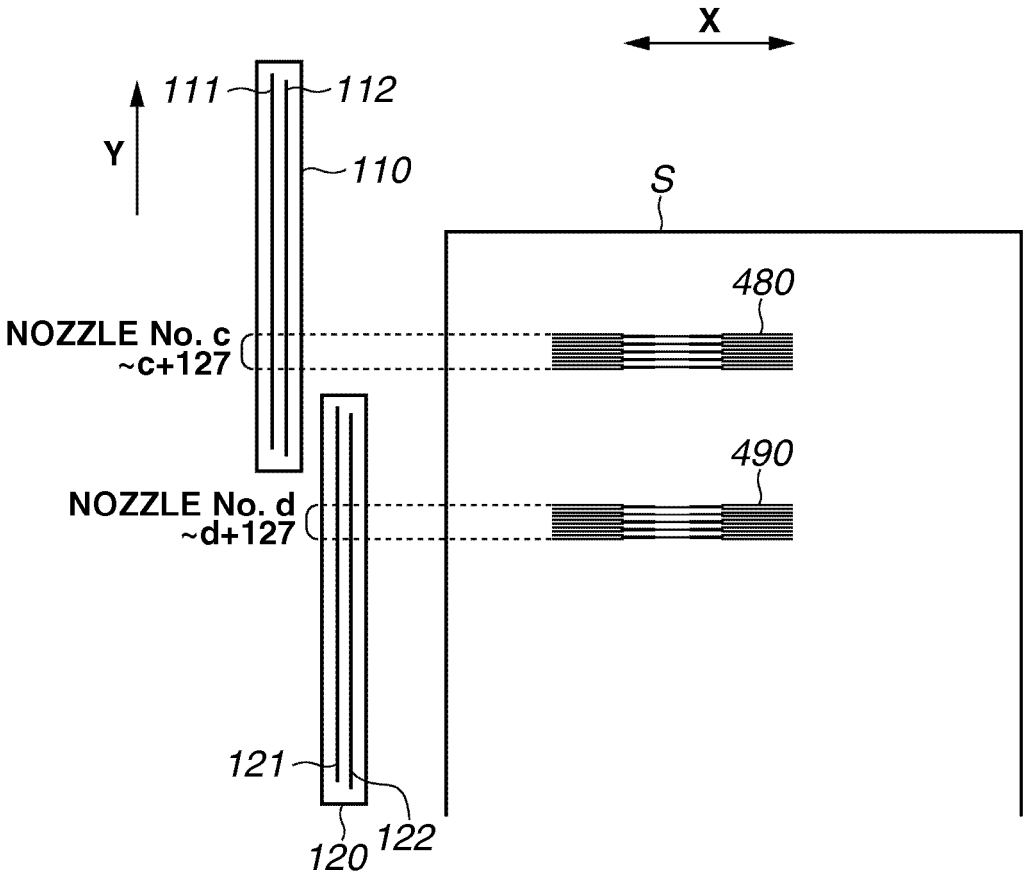

FIG. 7C illustrates the recording method of the non-reference patterns of the recording position correction pattern 480 and the conveyance error detection pattern 490. After the recording medium is conveyed for the predetermined conveyance amount L, the recording head 301 moves horizontally so that a non-reference pattern 480*b* is recorded over the reference pattern 480*a* of the recording position correction pattern 480 by the 128 nozzles from the nozzle No. c of the downstream chip 110. Accordingly, the seven patches of the recording position correction pattern 480 are completed.

Further, in the same scanning, a non-reference pattern 490*b* is recorded over the reference pattern 490*a* of the conveyance error detection pattern by the 128 nozzles from the nozzle No. d of the upstream chip 120. Accordingly, seven patches of the conveyance error detection pattern 490 are completed.

After the recording of the recording position correction pattern 480 and the conveyance error detection pattern 490 is finished, optical density of each patch is obtained using reflected light intensity. The reflected light intensity is obtained as an output value of the optical sensor 30 provided on the carriage 202. The output intensity of the optical sensor 30 is determined according to reflection intensity of the LED light irradiated on the recording medium S. Thus, the output value of the sensor becomes smaller if the area of the recording medium S covered by the ink is greater, and the sensor output value becomes greater if the ink area is smaller.

Figure 8:
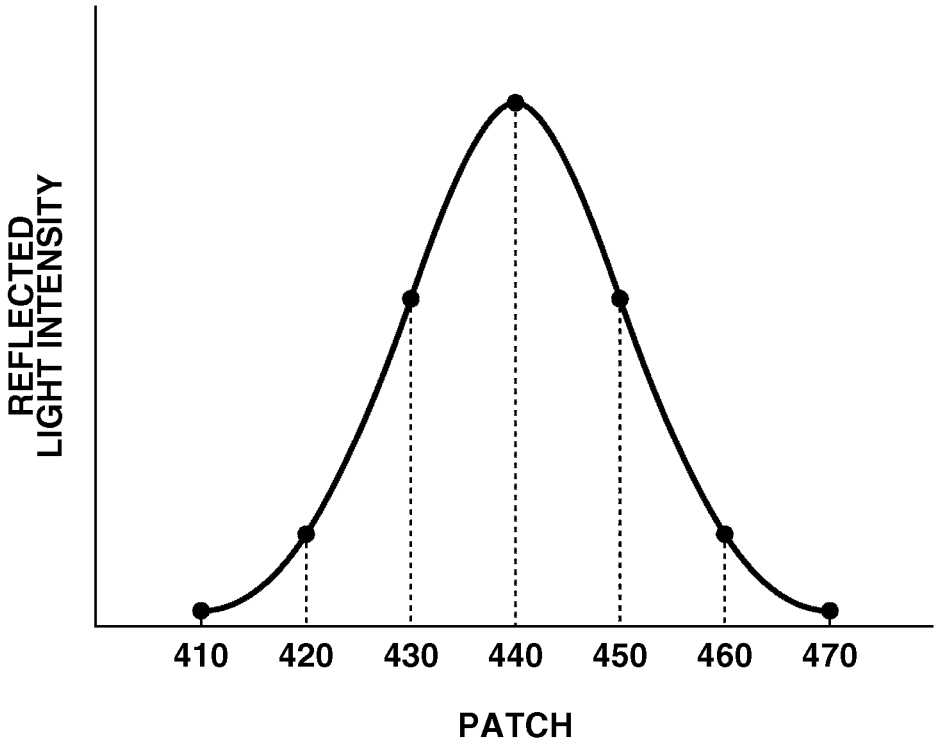
FIG. 8 illustrates a relation between a patch and an output value.

FIG. 8 illustrates an example of a measurement result of the reflected light intensity when the reflected light intensity of the seven patches is measured by the optical sensor 30.

If the test pattern is recorded under the ideal condition, the relation between the patch and reflected light intensity regarding both the recording position correction pattern 480 and the conveyance error detection pattern 490 will be as illustrated in FIG. 8. In other words, since the shift amount of the patch 440 is 0, and thus the recording position (dot impact positions) of the non-reference pattern coincides with the recording position of the reference pattern, the ink area of the patch 440 will be the smallest and the sensor output will be the greatest.

On the other hand, if the shift amount is relatively large as is with the patch 410 or 470 where the dots of the non-reference pattern do not overlap with the dots of the reference pattern, the ink area is large and the output value of the optical sensor is small.

A correction value of the recording position shift can be obtained by detecting a patch whose sensor output value is the greatest from the test pattern and by obtaining its shift amount. For example, if a patch whose shift amount is 1/1200 inch in the conveying direction is detected as the patch having the greatest sensor output, the shift amount of the nozzle array corresponds to 1/1200 inch toward the conveying direction. Then, a value used for correcting this shift amount will be the correction value. Further, in the case of the conveyance error detection pattern, the amount of the conveyance error is detected as 1/1200 inch opposite the conveying direction.

According to the present exemplary embodiment, seven patches are recorded as the recording position correction pattern 480, and similarly, seven patches are recorded as the conveyance error detection pattern 490. A patch having the greatest sensor output value out of the seven patches of the recording position correction pattern 480 is detected, and the correction value used for correcting the relative shift in the recording positions of the nozzle arrays is acquired from the shift amount. Similarly, a patch having the greatest sensor output value out of the seven patches of the conveyance error detection pattern 490 is detected, and from the shift amount of the detected patch, an amount of the conveyance error when the recording medium is conveyed for the predetermined conveyance amount L is detected.

According to the processing of the present exemplary embodiment, the correction value of the recording position shift is changed according to the detected amount of the conveyance error. In other words, the recording position correction pattern 480 is a pattern recorded while a predetermined conveyance operation is incorporated. Thus, a correction value of the recording position shift obtained by using this pattern incorporates the conveyance error that occurred during the conveyance operation. Thus, the conveyance error can be removed by changing the correction value of the recording position shift according to the amount of the conveyance error detected by using the conveyance error detection pattern.

The above-described processing is realized by the CPU 50 executing a program stored in the ROM 71. Further, a final recording position shift correction value, which is a correction value changed according to the amount of the conveyance error, is stored in the RAM 72. Furthermore, when the image recording is actually performed, the CPU 50 refers to the correction value and corrects the recording position.

More precisely, the nozzles of one chip will be shifted based on the correction value, or without changing the nozzles, a relative shift in the recording positions is corrected by shifting the binary recording data a number of pixels corresponding to the correction value.

Figure 9:
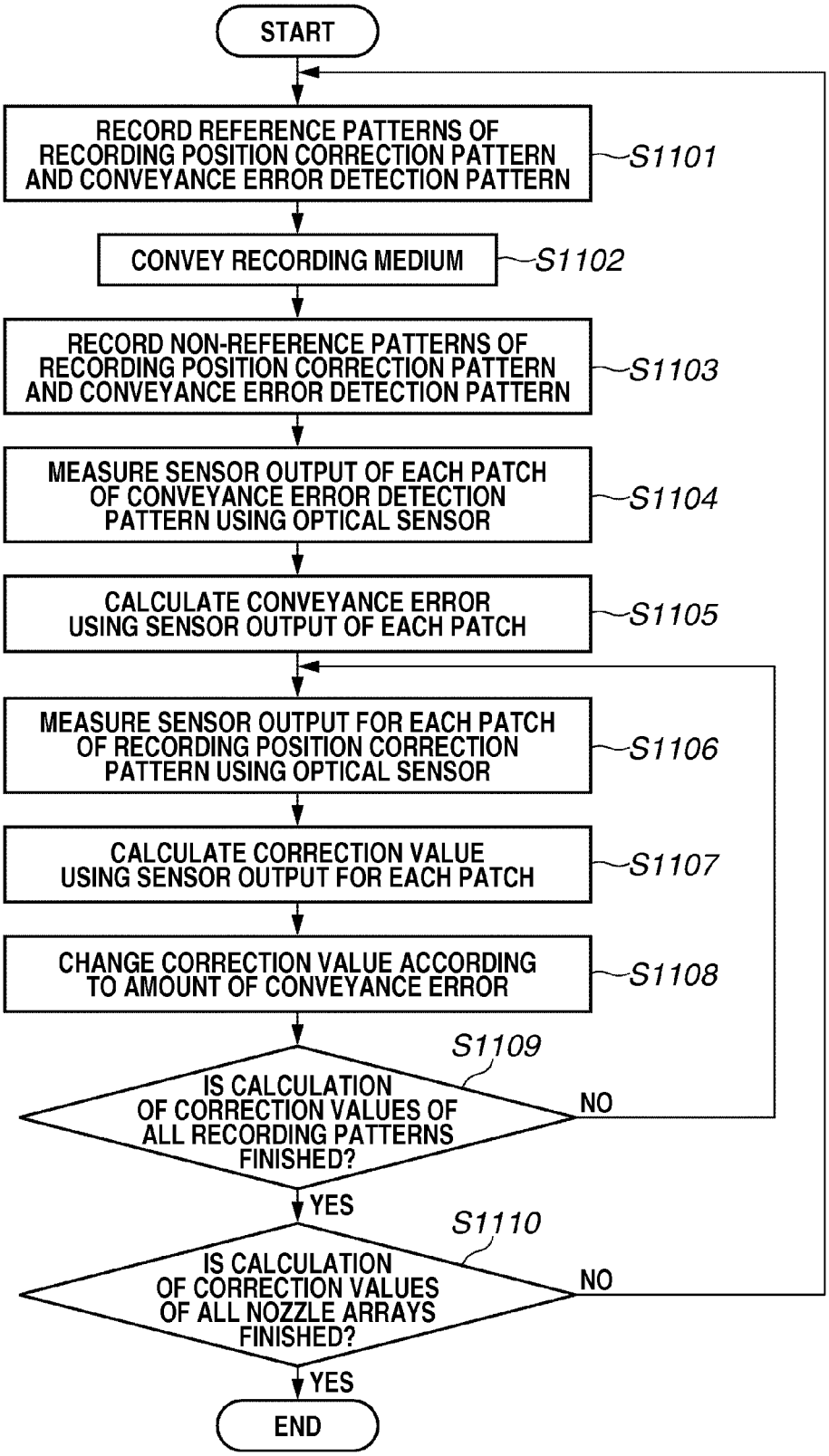
FIG. 9 is a flowchart illustrating an operation of recording position adjustment control according to the first exemplary embodiment.

FIG. 9 is a flowchart illustrating the recording position adjustment processing according to the present exemplary embodiment.

In steps S1101 to S1103, the CPU 50 performs the recording processing of the reference patterns and the non-reference patterns of the recording position correction pattern and the conveyance error detection pattern described above referring to FIG. 7. In steps S1104 to S1107, the light intensity reflected from each patch is measured by the optical sensor, and the correction value and the amount of the conveyance error are obtained according to the result of the measurement. In step S1108, the CPU 50 changes the correction value according to the amount of the conveyance error.

In step S1109, the CPU 50 determines whether the calculation of the correction values of all the nozzle arrays of the test patterns recorded in steps S1101 and S1103 is completed. If the CPU 50 determines that a pattern whose calculation of the correction value is not yet completed exists (NO in step S1109), the processing returns to step S1106, and the calculation of the correction value is continued.

In step S1110, the CPU 50 determines whether the calculation of the correction values of the nozzle arrays of all the colors is finished. If a nozzle array of a color whose correction value is not yet calculated exists (NO in step S1110), the processing returns to step S1101, and the recording of the test pattern is performed again. Since positional accuracy of the nozzle arrays of a same chip is high, if a correction value of a nozzle array of one color is calculated, the obtained value can also be used as the correction value of other colors.

As described above, according to the present exemplary embodiment, by using the first nozzle group (128 nozzles from the nozzle No. a) of the upstream chip 120 and the second nozzle group (128 nozzles from the nozzle No. c) of the downstream chip 110, a recording position correction pattern as the first pattern is recorded. According to this recording position correction pattern, a recording position shift amount in the conveying direction with respect to the nozzle array of the upstream chip 120 and the nozzle array of the downstream chip 110 is detected.

However, when the recording position correction pattern is recorded, the recording medium S is also conveyed for the predetermined conveyance amount L. Thus, the conveyance error that occurred at that time may affect the recording position shift amount of the nozzle array of the upstream chip 120 and the nozzle array of the downstream chip 110.

Thus, according to the present exemplary embodiment, a third nozzle group (128 nozzles from the nozzle No. b) of the upstream chip 120 and a fourth nozzle group (128 nozzles from the nozzle No. d) of the nozzle array in the upstream chip 120 are used in the recording of the conveyance error detection pattern as the second pattern.

The second pattern is recorded using only the nozzle arrays of the upstream chip. Thus, it can be used for the detection of the conveyance error that occurs when the recording medium is conveyed for the predetermined conveyance amount L. Further, the recording position shift amount in the conveying direction between the nozzle array of the upstream chip and the nozzle array of the downstream chip can be accurately detected by changing the correction value used for correcting the relative shift in the recording positions of the nozzle arrays according to the detected amount of error.

According to a second exemplary embodiment of the present invention, configurations of the recording position correction pattern and the conveyance error detection pattern are different from those of the first exemplary embodiment. Further, although a patch with the least shift is determined according to the output value of the optical sensor in the first exemplary embodiment, the patch with the least shift is determined by the user according to the present exemplary embodiment. According to the present exemplary embodiment, components similar to those in the first exemplary embodiment are denoted by the same reference numerals and their description is omitted for simplification.

Figure 10A:
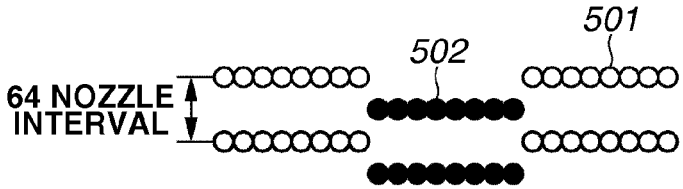
FIGS. 10A to 10C illustrates a test pattern according to a second exemplary embodiment of the present invention.
Figure 10B:
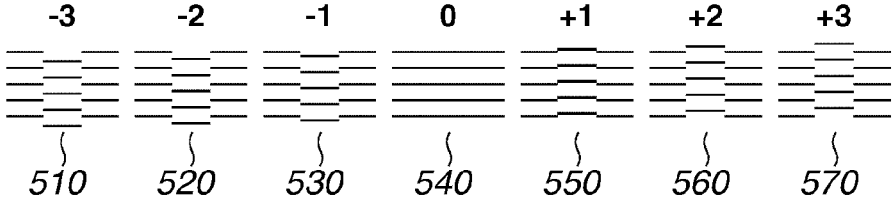
Figure 10C:
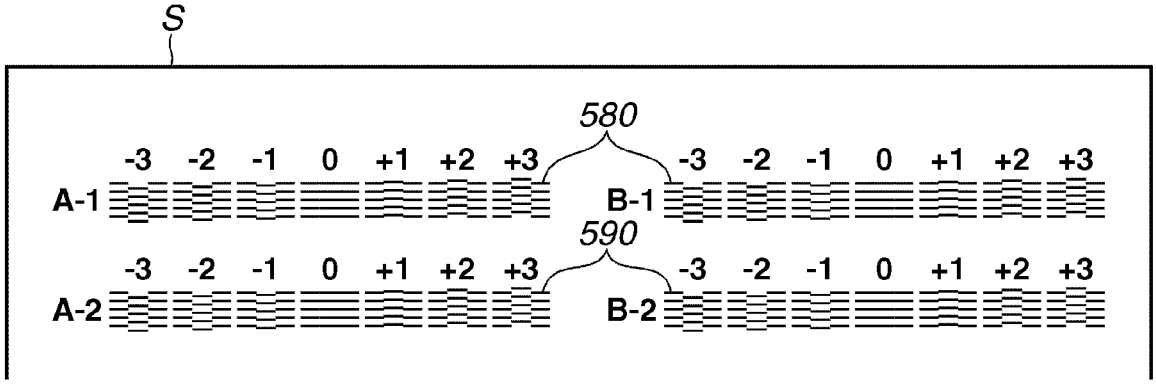

FIGS. 10A to 10C illustrate a test pattern according to the present exemplary embodiment. The illustrated test pattern is used as the recording position correction pattern as well as the conveyance error detection pattern. FIG. 10A illustrates one patch included in the test pattern according to the present exemplary embodiment.

Each patch includes lines of a reference pattern 501 on both sides of a line of a non-reference pattern 502. According to the present exemplary embodiment, the interval between the lines in the conveying direction corresponds to 64 nozzles (approximately 1.3 mm) so that the user can determine the line shift of the reference pattern and the non-reference pattern by visual inspection. Further, since the pattern may not be correctly recorded due to nozzle failure if only one line is recorded, a plurality of lines is recorded in one patch.

FIG. 10B illustrates the entire test pattern.

The test pattern includes seven patches (510 to 570) whose relative positions of the reference pattern 501 and the non-reference pattern 502 are different in the conveying direction. As is with the first exemplary embodiment, the relative position of the non-reference pattern 502 with respect to the reference pattern 501 in the patches 510 to 570 is shifted at a pitch of 1200 dpi. Each of numbers −3 to +3 indicated at the upper portion of each patch indicates the shift amount of the patch in units of 1200 dpi.

The recording method of the recording position correction pattern and the conveyance error detection pattern is similar to that of the first exemplary embodiment. More specifically, first, the recording head 301 is moved horizontally so that a reference pattern of the recording position correction pattern is recorded by a portion of a nozzle array (128 nozzles from the nozzle No. a) of the upstream chip 120.

After then, a reference pattern of the conveyance error detection pattern is recorded by a portion of a nozzle array (128 nozzles from the nozzle No. b) of the upstream chip 120. Then, after the recording medium S is conveyed, the recording position correction pattern is completed by a portion of a nozzle array (128 nozzles from the nozzle No. c) of the downstream chip 110. Further, the conveyance error detection pattern is completed by a portion of a nozzle array (128 nozzles from the nozzle No. d) of the upstream chip 120.

FIG. 10C illustrates a recording position correction pattern and a conveyance error detection pattern recorded on the recording medium S. A recording position correction pattern 580 is recorded by a nozzle array of the upstream chip 120 and a nozzle array of the downstream chip 110. Further, a conveyance error detection pattern 590 is recorded by only the nozzle arrays of the upstream chip 120.

Each of IDs "A-1", "A-2", "B-1", and "B-2" is recorded on the left side of each test pattern. "A" and "B" indicate the combination of the nozzle arrays. "1" and "2" indicate whether the patterns is the recording position correction pattern or the conveyance error detection pattern. According to the IDs, a type of each test pattern can be identified.

Further, in FIG. 10C, the conveyance error detection pattern is recorded for each of the recording position correction patterns. However, if reference patterns of a plurality of colors are recorded prior to the conveyance of the recording medium S and if non-reference patterns of a plurality of colors are recorded after the conveyance of the recording medium S, only one conveyance error detection pattern is used for the recording position correction patterns of a plurality of colors.

According to the present exemplary embodiment, the user selects a patch with the least shift between the line of the reference pattern and the line of the non-reference pattern by visually checking the test pattern. Then, a correction value and an amount of conveyance error of the recording position shift are obtained according to the selected patch.

Figure 11:
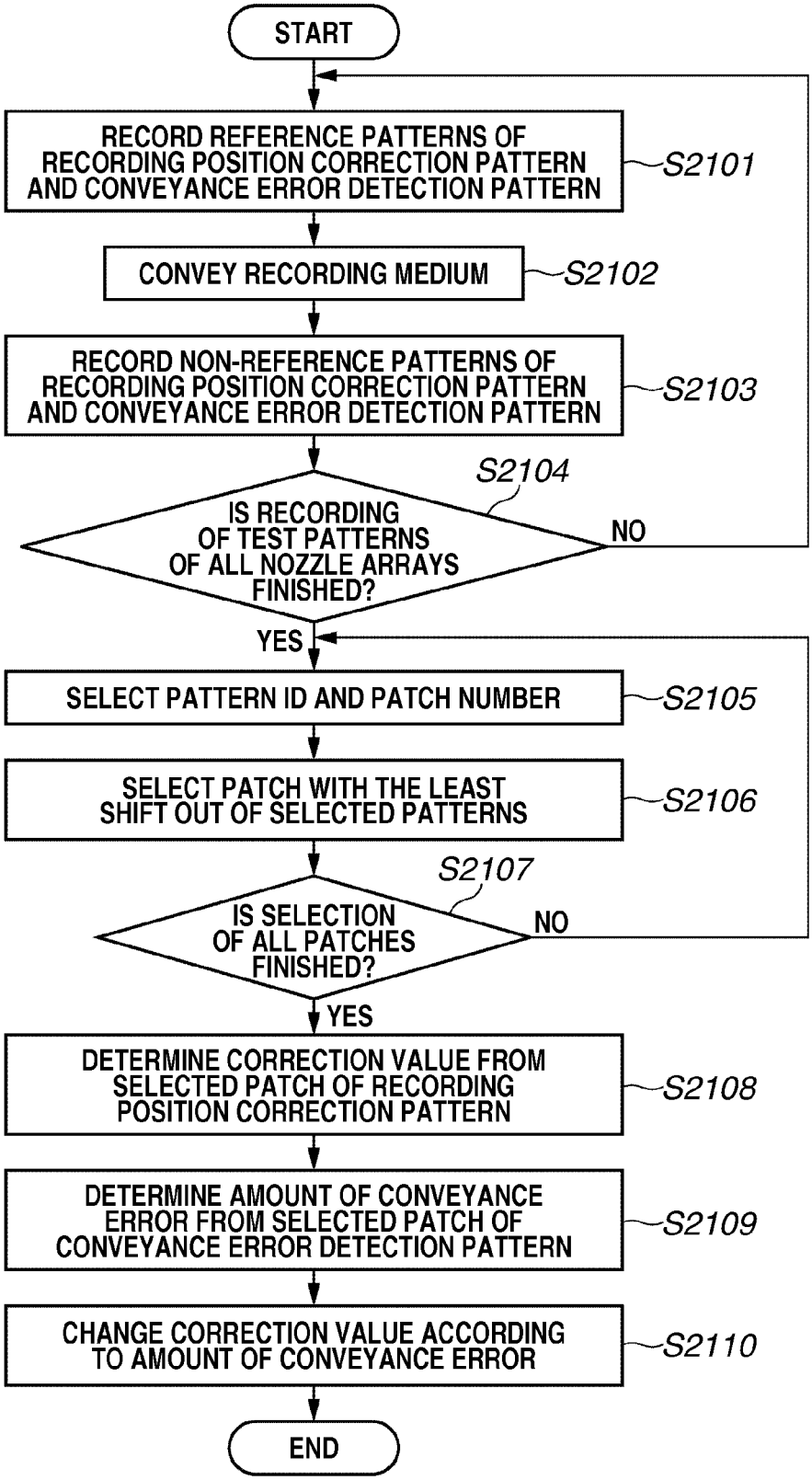
FIG. 11 is a flowchart illustrating an operation of recording position adjustment control according to the second exemplary embodiment.

FIG. 11 is a flowchart illustrating recording position adjustment processing according to the present exemplary embodiment. In steps S2101 to S2103, the recording of the reference patterns and the non-reference patterns of the recording position correction pattern and the conveyance error detection pattern is performed. In step S2104, the CPU 50 determines whether a nozzle array whose test pattern has not yet been recorded exists. If such a nozzle array exists (NO in step S2104), the processing returns to step S2101, and the recording of the test pattern is repeated until the test patterns of all the colors (nozzle arrays) are recorded.

In steps S2105 and S2106, the user confirms the line shift of each of the output test patterns, and selects the patch with the least shift out of the patches"−3" to "+3", and inputs an ID and the selected patch number using an operation panel of the recording apparatus or a host computer.

If the CPU 50 determines that the selection of all the patches of the test patterns has been finished (YES in step S2107), the processing proceeds to step S2108. In step S2108, the CPU 50 determines the correction value from the patch number selected from the recording position correction pattern 580. In step S2109, the CPU 50 determines the amount of the conveyance error according to the patch number selected from the conveyance error detection pattern 590. In step S2110, the CPU 50 changes the correction value according to the amount of the conveyance error that is determined.

According to a third exemplary embodiment of the present invention, the nozzle positions used for recording the recording position correction pattern and the conveyance error detection pattern are different from those of the first exemplary embodiment. According to the present exemplary embodiment, components similar to those in the first exemplary embodiment are denoted by the same reference numerals and their description is omitted for simplification.

According to the first exemplary embodiment, the recording position correction pattern is recorded by the nozzles (nozzles of the nozzle No. "a" to No. "a+127") of the upstream chip 120 and by the nozzles (nozzles of the nozzle No. "c" to No. "c+127") of the downstream chip 110. Further, the conveyance correction pattern is recorded by the nozzles (nozzles of the nozzle No. "b" to No. "b+127") of the upstream chip 120 and by the nozzles (nozzles of the nozzle No. "d" to No. "d+127") of the upstream chip 120.

When the recording of the patterns is performed, due to the difference in ink discharge characteristics of each nozzle, an error due to such a difference is added to the recording position correction pattern and the conveyance error detection pattern. Thus, when the position correction pattern and the conveyance error detection pattern are recorded, it is appropriate to use the same nozzles so that the obtained result is not affected by the ink discharge characteristics.

According to the present exemplary embodiment, the same nozzles are used for the recording of the reference pattern of the recording position correction pattern and the non-reference pattern of the conveyance error detection pattern. In other words, the interval of the recording position correction pattern and the conveyance error detection pattern equals the predetermined conveyance amount L.

Figure 12:
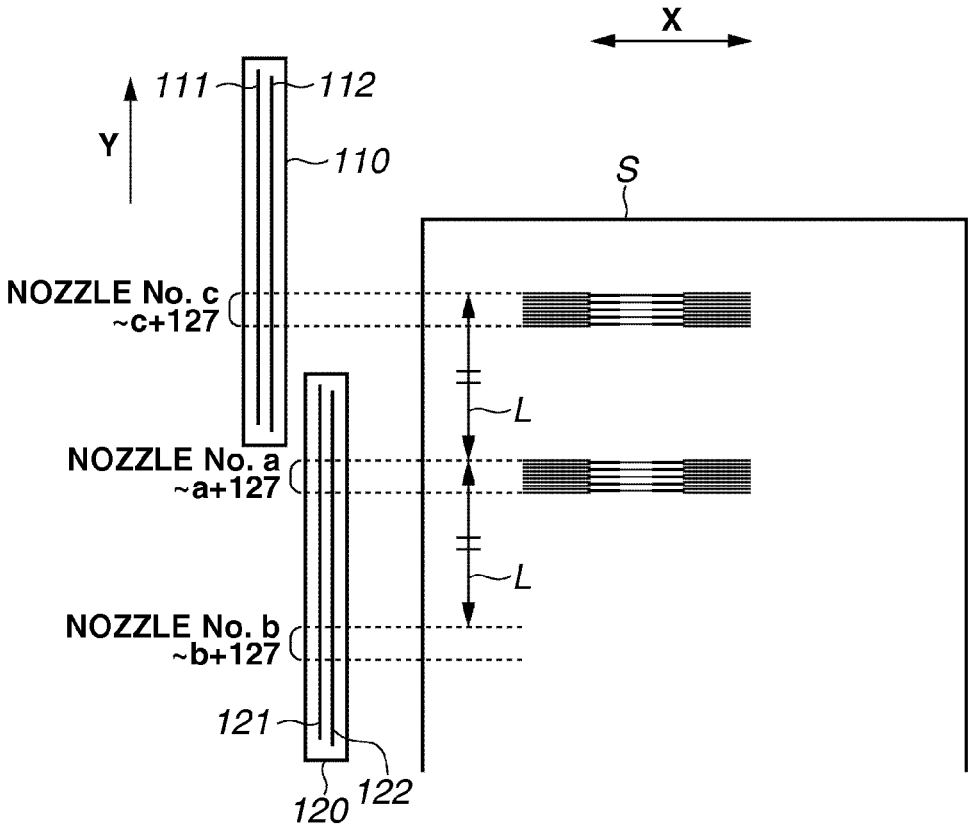
FIG. 12 illustrates a recording method of the test pattern according to a third exemplary embodiment of the present invention.

FIG. 12 illustrates a recording method of a test pattern according to the present exemplary embodiment. First, the recording head 301 is moved horizontally so that the reference pattern of the recording position correction pattern is recorded by the nozzles from the nozzle No. a to No. a+127, and then the reference pattern of the conveyance error detection pattern is recorded by the nozzles from the nozzle No. b to No. b+127. This processing is the same as what is described in the first exemplary embodiment.

Next, the recording medium S is conveyed for the predetermined conveyance amount L so that the reference pattern is moved to the nozzle position of the nozzles used for recording the non-reference pattern. At this time, the reference pattern of the conveyance error detection pattern is adjusted so that its position matches the nozzles from the nozzle No. "a" to No. "a+127". In other words, the predetermined conveyance amount L equals the distance between the nozzle No. "a" and the nozzle No. "b".

In this way, the nozzles from the nozzle No. "a" to No. "a+127" are used for recording the non-reference pattern of the conveyance error detection pattern. Thus, the same nozzles will be used for the recording of the reference pattern of the recording position correction pattern and the non-reference pattern of the conveyance error detection pattern. The non-reference pattern of the recording position correction pattern is recorded by the nozzles (nozzles from nozzle No. "c" to No. "c+127") of the downstream chip 110.

As described above, according to the present exemplary embodiment, since the nozzles used for recording the reference pattern of the recording position correction pattern and the non-reference pattern of the conveyance error detection pattern are the same, the effect of difference due to the ink discharge characteristics of each nozzle can be reduced.

Although the above-described examples use a connected head including a plurality of chips arranged in the conveying direction, the present invention is not limited to such a configuration. For example, separate recording heads arranged in the conveying direction so that the heads can be considered as one recording head having a long nozzle array may also be used. Further, the overlap region of the plurality of nozzle arrays is not always necessary.

The present invention can be applied to various cases where a pattern for correcting a relative shift in recording positions with respect to a plurality of nozzle arrays is recorded while a recording medium is conveyed. Thus, the present invention is not limited to the arrangement of the nozzle arrays.

Further, the reference pattern of the recording position correction pattern and the reference pattern of the conveyance error detection pattern are not necessarily recorded by one scanning operation. If the conveyance of the recording medium is not included in the operation, the patterns can be recorded by different scanning operations. Similarly, the non-reference pattern of the recording position correction pattern and the non-reference pattern of the conveyance error detection pattern can also be recorded by different scanning operations.

According to the first exemplary embodiment, the reflected light intensity of each patch is measured using a sensor, and a patch having the greatest output value is selected. However, the user can also select the patch according to visual inspection. In this case, the dots of the reference pattern and the non-reference pattern are arranged so that the user can easily determine a patch having the least reflected light intensity (i.e., greatest reflected light density) as the optimum patch.

Further, according to the second exemplary embodiment, although the user selects a patch whose line does not include a shift by visual inspection, a high resolution optical sensor may be used for determining the shift of the line.

Furthermore, regarding the method for calculating the correction value and the amount of the conveyance error, a method other than using the shift amount of a patch whose sensor output value is the greatest can be used. For example, an approximate curve can be calculated according to the output value of each patch. Then, the correction value and the amount of the conveyance error can be calculated by using a shift amount at the peak value of the curve.

In this case, since the shift amount may be calculated at a pitch finer than 1200 dpi, a value in units of the nozzle pitch, which is the closest to the shift amount with which the peak value is obtained, will be calculated as the correction value.

Further, in addition to changing a correction value used for correcting relative recording shift in positions of nozzle arrays, the conveyance error pattern can also be used in correcting the conveyance error. In such a case, the predetermined conveyance amount L used for recording the recording position correction pattern and the conveyance error detection pattern is set so that it corresponds to a conveyance amount for one recording operation.

Further, when the recording position correction pattern is recorded using a connected head, if the pattern is recorded at the overlap region of each of two nozzles arrays, the recording medium is not necessarily conveyed. However, if the overlap region is a small region including only 10 nozzles as is with the present exemplary embodiment, and if a width corresponding to 128 nozzles is used for the width of the patch in the conveying direction, incorporating the conveyance operation in recording the recording position correction pattern is to be performed. The present invention is especially useful in such a configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-137339 filed Jun. 8, 2009, which is hereby incorporated by reference herein in its entirety.

What is claimed is:

1. A recording apparatus comprising:

a moving unit configured to move a first nozzle array and a second nozzle array, each provided with a plurality of nozzles for discharging ink, the plurality of nozzles being arranged in a predetermined direction, relative to a recording medium in a moving direction intersecting the predetermined direction in order to record an image on the recording medium;

a forming unit configured to record on the recording medium a pattern using a first nozzle group which is one part of the first nozzle array and a pattern using a third nozzle group which is another part of the first nozzle array and convey the recording medium in a direction intersecting the moving direction to form on the recording medium a first pattern and a second pattern which is used for detecting a conveyance error, the first pattern being formed by recording, on the conveyed recording medium using a second nozzle group which is one part of the second nozzle array, a pattern at a position corresponding to a position where the pattern recorded using the first nozzle group exists, and the second pattern being formed by recording, on the conveyed recording medium using the first nozzle group, a pattern at a position corresponding to a position where the pattern recorded using the third nozzle group exists; and an adjusting unit configured to perform, based on the first pattern and the second pattern, relative position adjustment in the predetermined direction between a recording position with the first nozzle array and a recording position with the second nozzle array.

2. The recording apparatus according to claim 1, wherein the first nozzle array and the second nozzle array are used for discharging ink of a same color.

3. The recording apparatus according to claim 1, wherein the first pattern includes a plurality of patches each having a different optical density by differentiating a shift amount of the pattern recorded using the first nozzle group from a shift amount of the pattern recorded using the second nozzle group in the predetermined direction, and the second pattern includes a plurality of patches each having a different optical density by differentiating a shift amount of the pattern recorded using the first nozzle group from a shift amount of the pattern recorded using the third nozzle group in the predetermined direction.

4. The recording apparatus according to claim 3, further comprising an optical sensor configured to detect each optical density of each of the plurality of patches of the first pattern and of the second pattern.

5. The recording apparatus according to claim 1, wherein the first nozzle array and the second nozzle array are provided in different chips which are included in a same recording head.

6. The recording apparatus according to claim 1, wherein the first nozzle array and the second nozzle array are provided in different recording heads.

7. The recording apparatus according to claim 1, wherein the first nozzle array and the second nozzle array are arranged in a manner such that they deviate from each other in the predetermined direction.

8. The recording apparatus according to claim 1, wherein a size in the predetermined direction of an area where the first nozzle array and the second nozzle array overlap each other is smaller than a width in the predetermined direction of the first pattern.

9. A method for performing recording position adjustment when, for recording an image on a recording medium, moving a first nozzle array and a second nozzle array, each provided with a plurality of nozzles for discharging ink, the plurality of nozzles being arranged in a predetermined direction, relative to the recording medium in a moving direction intersecting the predetermined direction, comprising:

recording on the recording medium a pattern using a first nozzle group which is one part of the first nozzle array and a pattern using a third nozzle group which is another part of the first nozzle array and convey the recording medium in the predetermined direction to form on the recording medium a first pattern and a second pattern which is used for detecting a conveyance error, the first pattern being formed by recording, on the conveyed recording medium using a second nozzle group which is one part of the second nozzle array, a pattern at a position corresponding to a position where the pattern recorded using the first nozzle group exists, and the second pattern being formed by recording, on the conveyed recording medium using the first nozzle group, a pattern at a position corresponding to a position where the pattern recorded using the third nozzle group exists; and performing, based on the first pattern and the second pattern, relative position adjustment between a recording position with the first nozzle array and a recording position with the second nozzle array in the predetermined direction.

10. The method according to claim 9, wherein the first nozzle array and the second nozzle array are used for discharging ink of a same color.

11. The method according to claim 9, wherein the first pattern includes a plurality of patches each having a different optical density by differentiating a shift amount of the pattern recorded using the first nozzle group from a shift amount of the pattern recorded using the second nozzle group in the predetermined direction, and the second pattern includes a plurality of patches each having a different optical density by differentiating a shift amount of the pattern recorded using the first nozzle group from a shift amount of the pattern recorded using the third nozzle group in the predetermined direction.

12. The method according to claim 11, further comprising detecting each optical density of each of the plurality of patches of the first pattern and of the second pattern.

13. The method according to claim 9, wherein the first nozzle array and the second nozzle array are provided in different chips which are included in a same recording head.

14. The method apparatus according to claim 9, wherein the first nozzle array and the second nozzle array are provided in different recording heads.

15. The method according to claim 9, wherein the first nozzle array and the second nozzle array are arranged in a manner such that they deviate from each other in the predetermined direction.

16. The method according to claim 9, wherein a size in the predetermined direction of an area where the first nozzle array and the second nozzle array overlap each other is smaller than a width in the predetermined direction of the first pattern.

* * * * *